US010850296B2

(12) United States Patent
Cox

(10) Patent No.: US 10,850,296 B2
(45) Date of Patent: Dec. 1, 2020

(54) SPA FILTRATION AND MASSAGE SYSTEM FOR A HOT TUB

(71) Applicant: Stephen Gayle Cox, Bradenton, FL (US)

(72) Inventor: Stephen Gayle Cox, Bradenton, FL (US)

( * ) Notice: Subject to any disclaimer, the term of this patent is extended or adjusted under 35 U.S.C. 154(b) by 0 days.

(21) Appl. No.: 16/800,985

(22) Filed: Feb. 25, 2020

(65) Prior Publication Data

US 2020/0269271 A1 Aug. 27, 2020

Related U.S. Application Data

(60) Provisional application No. 62/810,252, filed on Feb. 25, 2019, provisional application No. 62/925,686, filed on Oct. 24, 2019, provisional application No. 62/967,961, filed on Jan. 30, 2020.

(51) Int. Cl.
*B05B 15/652* (2018.01)
*E04H 4/12* (2006.01)

(52) U.S. Cl.
CPC ..... *B05B 15/652* (2018.02); *E04H 4/1209* (2013.01)

(58) Field of Classification Search
CPC ..... E04H 4/1209
USPC ..... 4/492
See application file for complete search history.

(56) References Cited

U.S. PATENT DOCUMENTS 3,631,987 A * 1/1972 Cattano, Sr. ..... B01D 29/23 210/452
4,233,694 A * 11/1980 Janosko ..... A61H 33/0087 210/167.12
4,253,959 A * 3/1981 Tafara ..... B01D 29/23 210/232
4,349,434 A * 9/1982 Jaworski ..... B01D 35/18 210/149
4,424,438 A * 1/1984 Antelman ..... A61H 33/005 219/491
4,637,873 A * 1/1987 DeSousa ..... E04H 4/1272 210/167.1
4,743,368 A * 5/1988 Gates ..... E04H 4/1272 210/136
4,921,606 A * 5/1990 Goldman ..... B01D 29/27 210/238

(Continued)

FOREIGN PATENT DOCUMENTS

WO WO2013020006 A1 2/2013

*Primary Examiner* — Lori L Baker

(57) ABSTRACT

A spa filtration and massage system for a hot tub is an apparatus that is a universal tool that connects with a jet of a hot tub. The apparatus includes a transformer and a dispensing wand. The transformer connects the dispensing wand with a jet. The transformer serves as an adapter for the dispensing wand. The dispenser wand is preferably connected with the transformer with a flexible hose and an adapter to lengthen the connection between transformer and the dispensing wand. In a first embodiment, the dispensing wand serves to filter the water of the hot tub as the dispensing wand includes a filtration receptacle, a cap, and a plurality of holes. A plurality of filters is positioned within the filtration receptacle. In a second embodiment, the dispensing wand dispenses the pressurized water as a spray. In a third embodiment, the dispensing wand serves as a massager.

5 Claims, 7 Drawing Sheets

(56) References Cited

U.S. PATENT DOCUMENTS 5,045,194 A * 9/1991 Gershenson ..... B01D 29/111 210/232
5,415,353 A * 5/1995 Jackson ..... F16L 13/007
5,480,096 A * 1/1996 Wilson ..... A01M 7/0035 239/146
5,493,754 A * 2/1996 Gurstein ..... A47L 11/34 15/246.3
5,522,114 A * 6/1996 Allison ..... A47L 11/34 15/320
5,542,147 A * 8/1996 Merten ..... A47L 11/34 15/321
5,624,559 A * 4/1997 Levin ..... B01D 29/23 210/447
5,669,532 A * 9/1997 Dorow ..... B05B 9/0816 222/401
5,672,271 A * 9/1997 Dye ..... E04H 4/1272 210/167.12
5,766,453 A * 6/1998 Morellato ..... B01D 61/08 141/360
5,850,640 A * 12/1998 Pinciaro ..... A61H 33/6063 4/541.6
6,007,714 A * 12/1999 Keith ..... B01D 29/15 210/167.12
6,094,773 A * 8/2000 Krentz ..... A47L 7/00 15/321
6,120,614 A * 9/2000 Damron ..... B08B 3/006 134/10
6,220,526 B1 * 4/2001 Johnson ..... B05B 9/007 222/95
6,309,538 B1 * 10/2001 Khan ..... C02F 1/008 210/143
6,342,841 B1 * 1/2002 Stingl ..... A61H 33/005 340/606
6,363,951 B1 * 4/2002 Wood ..... A23N 12/02 134/102.2
6,471,856 B1 * 10/2002 Keith ..... B01D 29/05 210/167.12
6,497,814 B1 * 12/2002 Alexander ..... E04H 4/1209 134/170
6,585,791 B1 * 7/2003 Garito ..... B01D 46/0038 55/385.1
6,706,174 B1 * 3/2004 Keith ..... B01D 29/01 210/167.12
6,880,191 B2 * 4/2005 Bristor ..... B01F 13/0033 134/100.1
6,939,463 B2 * 9/2005 Leaverton ..... C02F 1/00 210/167.12
7,143,897 B1 * 12/2006 Guzman ..... B01D 35/04 210/460
9,279,225 B1 * 3/2016 Prokupek ..... B01D 35/02
10,214,931 B2 * 2/2019 Saccoccio ..... E04H 4/12
10,221,853 B2 * 3/2019 Nix ..... C02F 1/008
10,486,985 B2 * 11/2019 Murdock ..... C02F 1/008
2003/0024485 A1 * 2/2003 Freidell ..... A01K 13/001 119/665
2003/0200605 A1 * 10/2003 Loyd ..... A61H 33/04 4/541.6
2013/0061944 A1 * 3/2013 Tarantino ..... E03B 1/048 137/101.27

* cited by examiner

SPA FILTRATION AND MASSAGE SYSTEM FOR A HOT TUB

The current application claims a priority to the U.S. provisional patent application Ser. No. 62/810,252 filed on Feb. 25, 2019, a priority to the U.S. provisional patent application Ser. No. 62/925,686 filed on Oct. 24, 2019, and a priority to the U.S. provisional patent application Ser. No. 62/967,961 filed on Jan. 30, 2020.

FIELD OF THE INVENTION

The present invention generally relates to hot tubs. More specifically, the present invention is a spa filtration and massage system for a hot tub that serves to preserve the hygiene of the hot tub and enhance the soothing effects of the hot tub.

BACKGROUND OF THE INVENTION

Hot tubs are commonly used to relieve physical pains and injuries and may be used daily according to the needs of the individual. The daily use of hot tubs however requires regular maintenance and thorough cleaning in order to maintain a clean and sanitary environment. Hot tubs are typically cleaned with various chemicals that must be continuously added with the water. In addition, the water within the hot tub itself must be replaced on a monthly basis.

It is therefore an objective of the present invention to provide a hassle free and cost-effective solution that effectively preserves clear and clean water within a hot tub. The present invention thoroughly filters the water of a hot tub without the need of any chemicals and enhances the massaging effects of the hot tub. The present invention utilizes the existing jets of a hot tub to clean the water and extend the pressure of the existing jets to specific parts of the body that the existing jets may not be able to reach.

DETAIL DESCRIPTIONS OF THE INVENTION

Figure 1:
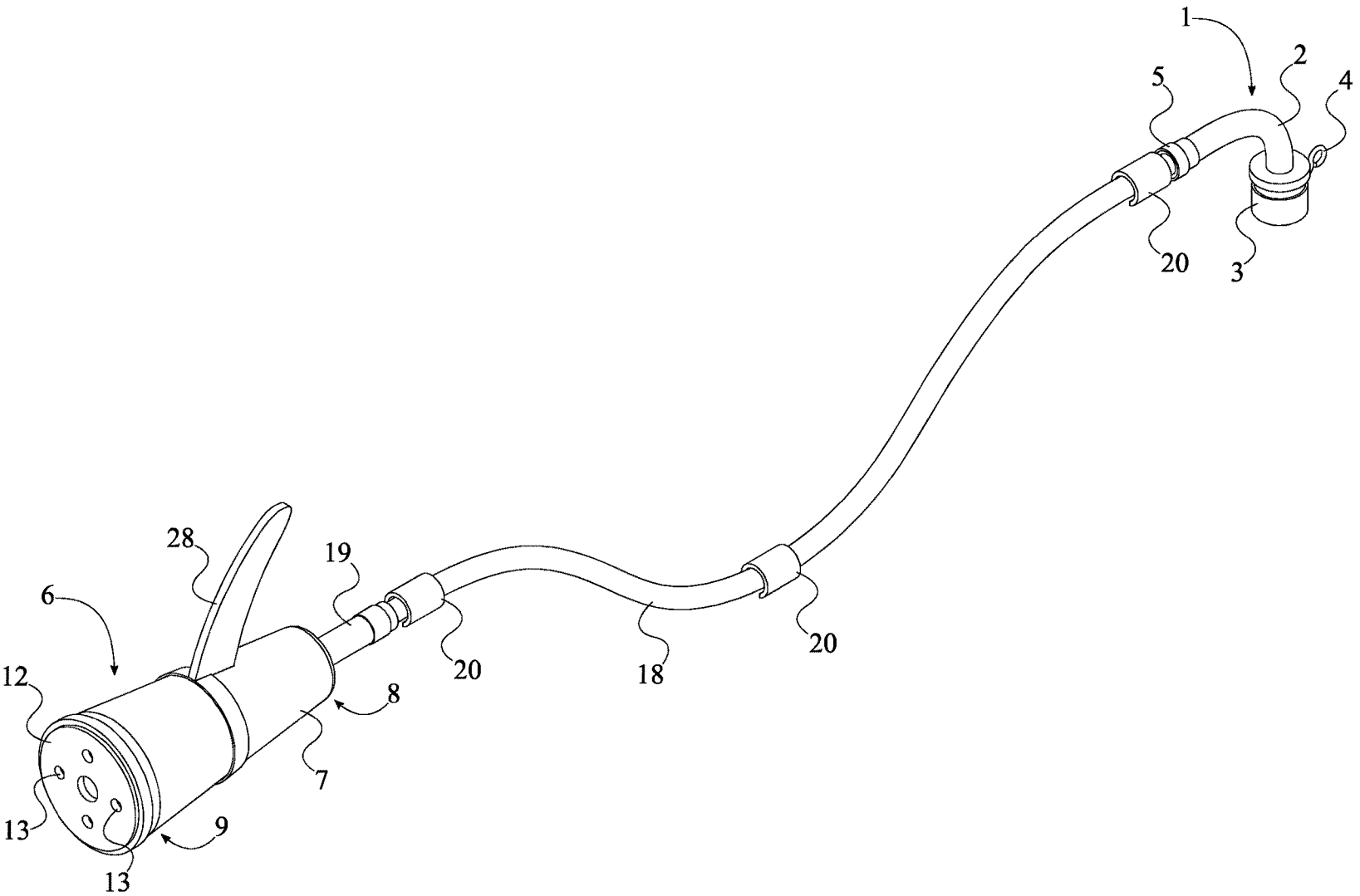
FIG. 1 is a perspective view of a first embodiment of the present invention with a dispensing wand connected to a transformer with a hose.

All illustrations of the drawings are for the purpose of describing selected versions of the present invention and are not intended to limit the scope of the present invention.

The present invention is a spa filtration and massage system for a hot tub the eliminates the need for any chemicals in order to thoroughly clean a hot tub. The present invention is eco-friendly and cost effective, requiring no power source as the present invention utilizes existing jets of the hot tub. The present invention also provides an extension for the existing jets, thereby enhancing the soothing and massaging effects of the hot tub. Moreover, the present invention is able to withstand the high speed and pressure of the existing jets and serves as a universal attachment to various sized existing jets. The present invention is compatible with commercial units as well as personal units. In order for the present invention to effectively filter water of a hot tub and enhance the massaging effects of the hot tub, the present invention comprises a transformer 1 and a dispensing wand 6, seen in FIG. 1, FIG. 2, FIG. 3, FIG. 6, and FIG. 7. The transformer 1 connects the dispensing wand 6 with an existing jet of a hot tub. The transformer 1 connects with various sized existing jets as the transformer 1 comprises an elongated tube 2, an inlet plug 3, a tightening bolt 4, and a hose coupler 5. The elongated tube 2 connects the inlet plug 3 with the hose coupler 5. In the preferred embodiment of the present invention, the elongated tube 2 comprises a bend that orients the hose coupler 5 away from the bottom of the hot tub. The inlet plug 3 attaches transformer 1 directly with the existing jet, directing the pressurized water into the transformer 1. The tightening bolt 4 secures the inlet plug 3 with the existing jet of various sizes. Moreover, the transformer 1 is able to be installed with a single horn jet of 3-inches, 4-inches, and 5-inches with the tightening bolt 4. The hose coupler 5 secures the dispensing wand 6 with the transformer 1 so that the dispensing wand 6 remains connected with the transformer 1 throughout the entire use of the dispensing wand 6.

The overall configuration of the aforementioned components allows the present invention to be installed with various sized jets of any hot tub. In order to mount the present invention with an existing jet of a hot tub, the inlet plug 3 is terminally positioned to the elongated tube 2, also seen in seen in FIG. 1, FIG. 2, FIG. 3, FIG. 6, and FIG. 7. The tightening bolt 4 is externally mounted with the inlet plug 3, allowing the user to manually adjust the connection between the inlet plug 3 and a corresponding jet. Moreover, the tightening bolt 4 is operatively coupled with the inlet plug 3, wherein the tightening bolt 4 widens and narrows the overall circumference of the inlet plug 3 creating a snug fit of the inlet plug 3 within the corresponding jet. The hose coupler 5 is terminally positioned to the elongated tube 2, opposite the inlet plug 3. This arrangement provides a continuous flow of pressurized water into and out of the transformer 1. The dispensing wand 6 is hermetically connected with the hose coupler 5, containing the pressurized water from the corresponding jet into the dispensing wand 6. Moreover, the inlet plug 3 is in fluid communication with the elongated tube 2, and the elongated tube 2 is in fluid communication with the hose coupler 5. The intensity of the pressurized water is therefore maintained through the transformer 1. Similarly, the hose coupler 5 is in fluid communication with the dispensing wand 6. The intensity of the pressurized water exiting the present invention through the dispensing wand 6 mirrors that of the corresponding pressurized jet.

In order for the dispensing wand 6 to be more easily accessible near the surface of the water within the hot tub, the present invention further comprises a flexible hose 18 and an adapter 19, seen in FIG. 1, FIG. 2, FIG. 6, and FIG. 7. The flexible hose 18 extends the connection between the transformer 1 and the dispensing wand 6. The flexible hose 18 allows the dispensing wand 6 to be maneuvered throughout the hot tube while remaining connected with the transformer 1. The adapter 19 provides a secure connection between the flexible hose 18 and the dispensing wand 6. The continuous flow of pressurized water from the transformer 1 is preserved as the flexible hose 18 is terminally positioned to the hose coupler 5. The adapter 19 and the dispensing wand 6 are terminally positioned to the flexible hose 18, opposite the hose coupler 5. This allows the dispensing wand 6 to connect to the flexible hose 18 with the adapter 19. Moreover, the hose coupler 5 is in fluid communication with the flexible hose 18, and the flexible hose 18 is in fluid communication with the dispensing wand 6 through the adapter 19, effectively extending the connection between transformer 1 and the dispensing wand 6 with the flexible hose 18.

Due to the weight of the dispensing wand 6, the dispensing wand 6 may sink below the surface of the water in the hot tub. In order for the dispensing wand 6 to remain along the surface of the water, the present invention comprises a plurality of floating nodes 20, seen in FIG. 1, FIG. 2, FIG. 3, FIG. 6, and FIG. 7. The plurality of floating nodes 20 preferably comprises buoyant materials such as foam. The flexible hose 18 traverses through each of the plurality of floating nodes 20, connecting the plurality of floating nodes 20 with the flexible hose 18. The plurality of floating nodes 20 is attached along the flexible hose 18 in order to counterbalance the weight of the dispensing wand 6. In the preferred embodiment of the present invention the plurality of floating nodes 20 is equally distributed along the flexible hose 18, with an individual floating node positioned adjacent the dispensing wand 6.

In a first embodiment of the present invention, seen in FIG. 1, FIG. 2, FIG. 3, FIG. 4, and FIG. 5. the dispensing wand 6 serves to filter the water of the hot tub. In order to filter the water, the present invention further comprises a plurality of filters 21, and the dispensing wand 6 comprises a filtration receptacle 7, a cap 12, and a plurality of holes 13. The plurality of filters 21 captures and retains microscopic contaminates. The water in hot tubs typically require harsh chemicals to remove microscopic contaminates of 10-200 microns that typical spa filters are not able to catch. The filtration receptacle 7 and the cap 12 house the plurality of filters 21. The cap 12 allows the filtration receptacle 7 to be opened and closed. Moreover, the filtration receptacle 7 comprises a first end 8, a second end 9, an inlet 10, and an outlet 11. The first end 8 connects the filtration receptacle 7 with the transformer 1 directly or with the transformer 1 through the flexible hose 18 and the adapter 19. The second end 9 connects the filtration receptacle 7 with the cap 12. The inlet 10 allows the pressurized water to enter the filtration receptacle 7, and the outlet 11 allows the pressurized water to exit the filtration receptacle 7. The plurality of holes 13 allows the pressurized water to be released through the dispensing wand 6. The arrangement for the dispensing wand 6 and the plurality of filters 21 allows the pressurized water of a corresponding jet to be filtered until all of the water in the hot tub is filtered. The plurality of filters 21 is housed within the filtration receptacle 7 as the first end 8 is positioned opposite the second end 9 about the filtration receptacle 7. The filtration receptacle 7 tapers from the second end 9 to the first end 8 in order to preserve the intensity and continuous flow of the pressurized water through the filtration receptacle 7. Moreover, the inlet 10 is integrated into the first end 8, and the outlet 11 is integrated into the second end 9. The first end 8 is connected with the hose coupler 5 so that the water enters the filtration receptacle 7 through the narrow end. The cap 12 traverses across the outlet 11, containing the plurality of filters 21 within the filtration receptacle 7. Furthermore, the cap 12 is removably coupled with the second end 9 so that the plurality of filters 21 is easily removed from within the filtration receptacle 7 through the wider end of the filtration receptacle 7. The plurality of holes 13 traverses through and is distributed across the cap 12 so that the pressurized water that has been filtered with the plurality of filters 21 continuously exit the dispensing wand 6. The pressurized water of the corresponding jet is filtered with the plurality of filters 21 as the plurality of filters 21 is positioned within the filtration receptacle 7.

Figure 2:
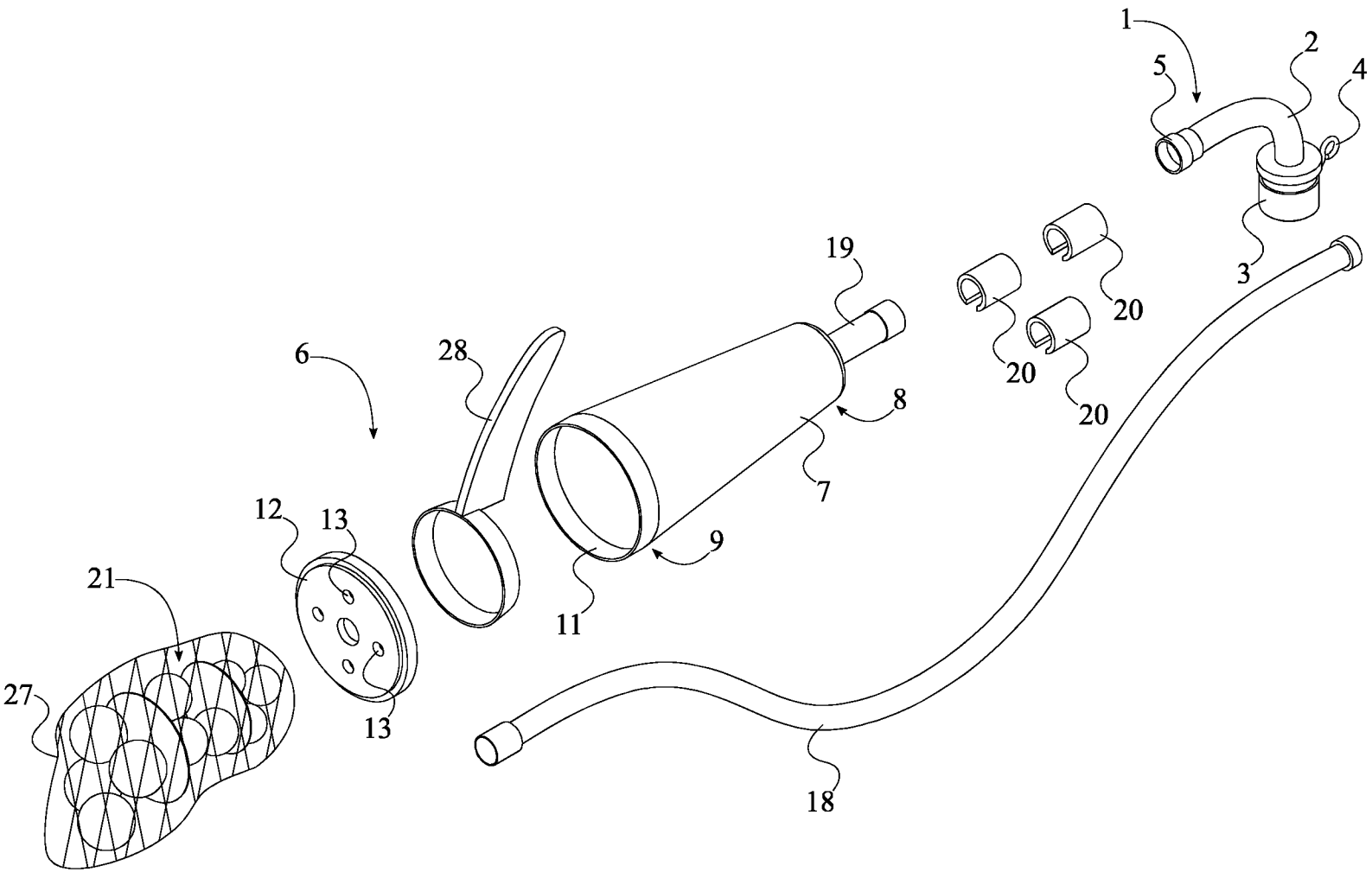
FIG. 2 is an exploded view of the first embodiment of the present invention with the hose.
Figure 3:
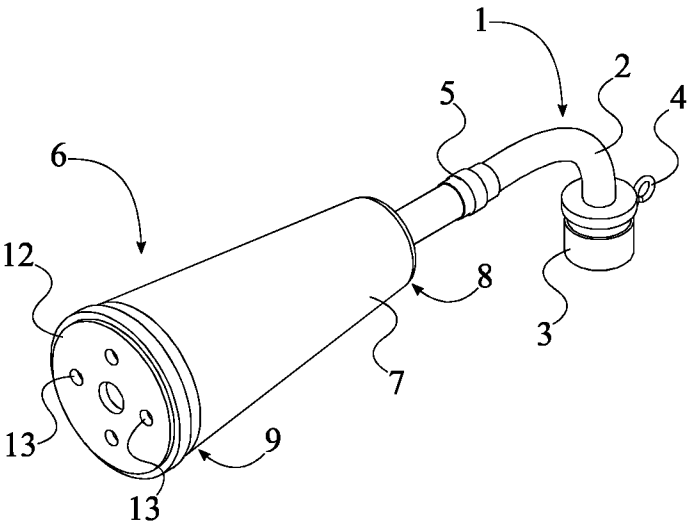
FIG. 3 is a perspective view of the first embodiment of the present invention with the dispensing wand connected to directly with the transformer.
Figure 4:
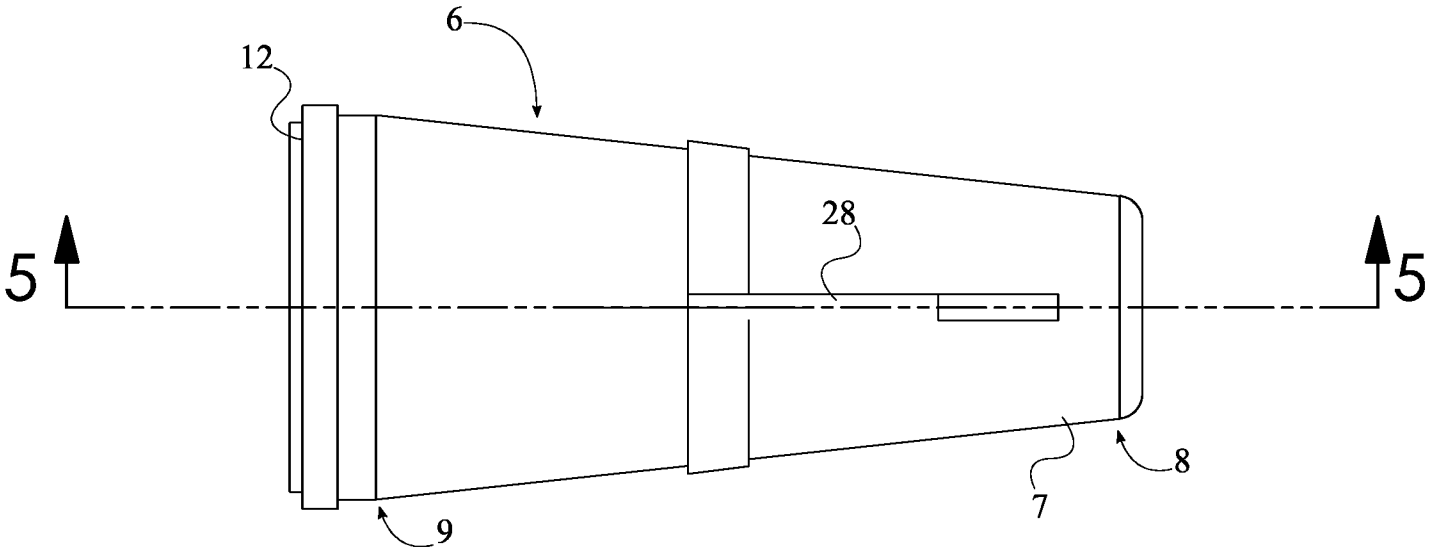
FIG. 4 is a top side view of the dispensing wand, a plurality of filters, and a decorative ornament of the first embodiment of the present invention.
Figure 5:
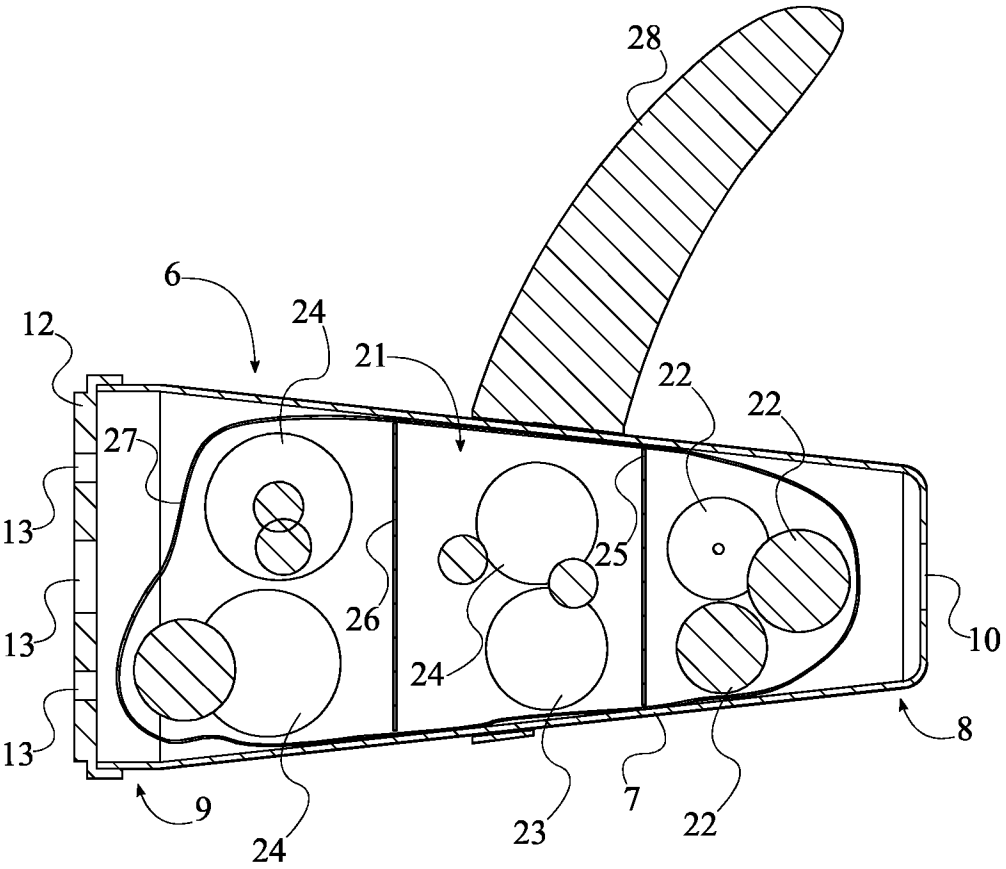
FIG. 5 is a cross-section view of FIG. 4 taken along line 5-5 of the present invention.

In the preferred embodiment of the present invention, the plurality of filters 21 comprises a plurality of first filter balls 22, a plurality of second filter balls 23, a plurality of third filter balls 24, at least one first filter sheet 25, and at least one first filter sheet 26, seen in FIG. 2 and FIG. 5. In order to effectively capture the microscopic contaminates, the at least one first filter 25 sheet is a 50-micron polished pad, and the at least one second filter 26 sheet is a 100-micron polished pad. The filtration of water is facilitated by sequentially capturing ranges of microscopic contaminates within partitions within the filtration receptacle 7. Each of the plurality of first filter balls 22 is a 30-to-60-micron filter. Each of the plurality of second filter balls 23 is a 60-to-90-micron filter. Each of the plurality of third filter balls 24 is a 90-to-120-micron filter. The plurality of first filter balls 22 is positioned adjacent with the first end 8. The at least one filter sheet is positioned adjacent with the plurality of first filter balls 22, opposite the first end 8. The plurality of second filter balls 23 is positioned adjacent with the at least one first filter sheet 25, opposite the plurality of first filter balls 22. The at least one second sheet 26 is positioned adjacent with the plurality of second filter balls 23, opposite the at least one first filter sheet 25. The plurality of third filter balls 24 is positioned adjacent with the at least one first filter sheet 26, opposite the plurality of second filter balls 23. Furthermore, in order to facilitate the removal and cleaning of each of the plurality of filters 21 simultaneously, the first embodiment of the present invention comprises a mesh pouch 27. This arrangement allows ensures the filtration of the smaller microscopic contaminates first, following with the capture of larger microscopic contaminates, providing clear water for the hot tub within a shorter amount of time. The mesh pouch 27 contains the plurality of filters 21 while allowing the plurality of filters 21 to effectively rid the pressurized water of microscopic contaminates. The mesh pouch 27 is also positioned within the filtration receptacle 7, and the plurality of filters 21 is positioned within the mesh pouch 27, facilitating the insertion and removal of the plurality of filters 21.

The first embodiment of the present invention further comprises at least one decorative ornament 28, seen in FIG. 1, FIG. 2, FIG. 4, and FIG. 5. The dispensing wand 6 is easily identified within the hot tub with the decorative ornament 28. The decorative ornament 28 is preferably a fin that resembles that of a shark. The decorative ornament 28 may also conceal the plurality of filters 21 within the filtration receptacle 7 from being seen outside the filtration receptacle 7. The at least one decorative ornament 28 is externally mounted to the filtration receptacle 7.

Figure 6:
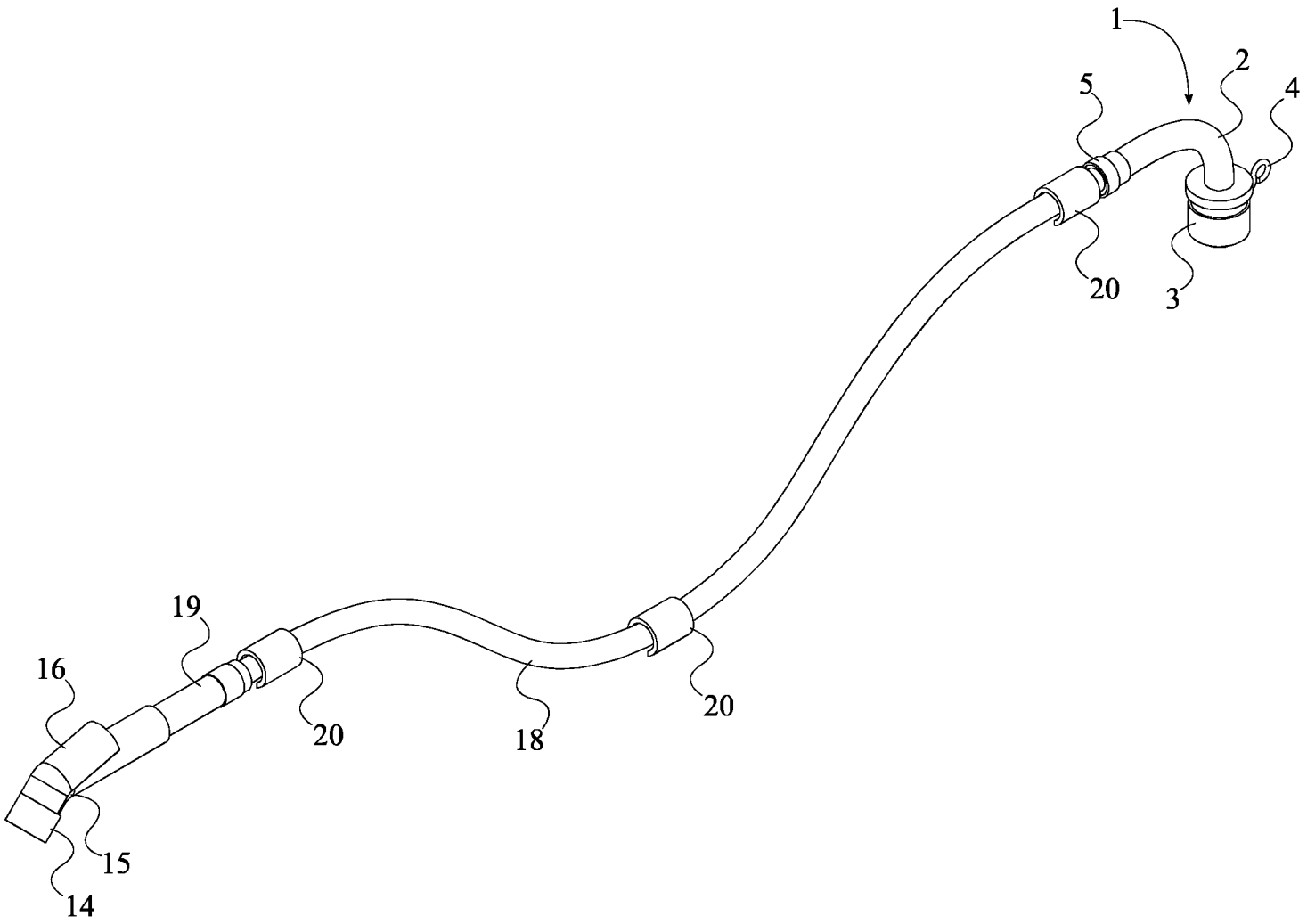
FIG. 6 is a perspective view of a second embodiment of the present invention with the dispensing wand connected to the transformer with the hose.

In a second embodiment of the present invention, the dispensing wand 6 comprises a spray nozzle 14, a valve 15, and an actuator 16, seen in FIG. 6. The second embodiment of the present invention allows a user to spray pressurized water directly onto surface areas that may require more force for thorough cleaning. The spray nozzle 14 dispenses the pressurized water as a spray. The valve 15 controls the pressure of the water from the pressurized jet through the spray nozzle 14. The actuator 16 opens and closes the spray nozzle 14. The spray nozzle 14 is hermetically connected with the hose coupler 5 in order contain the pressurized water into the spray nozzle 14. The actuator 16 is mounted onto the spray nozzle 14 so that a user may maneuver the actuator 16, and the valve 15 is integrated into the spray nozzle 14 to control the flow of water. The transformer 1 is in fluid communication with the spray nozzle 14, preferably through the flexible hose 18 and the adapter 19. Moreover, the actuator 16 is operatively coupled to the valve 15, wherein the actuator 16 is used to open or close for the valve 15 for the spray nozzle 14.

Figure 7:
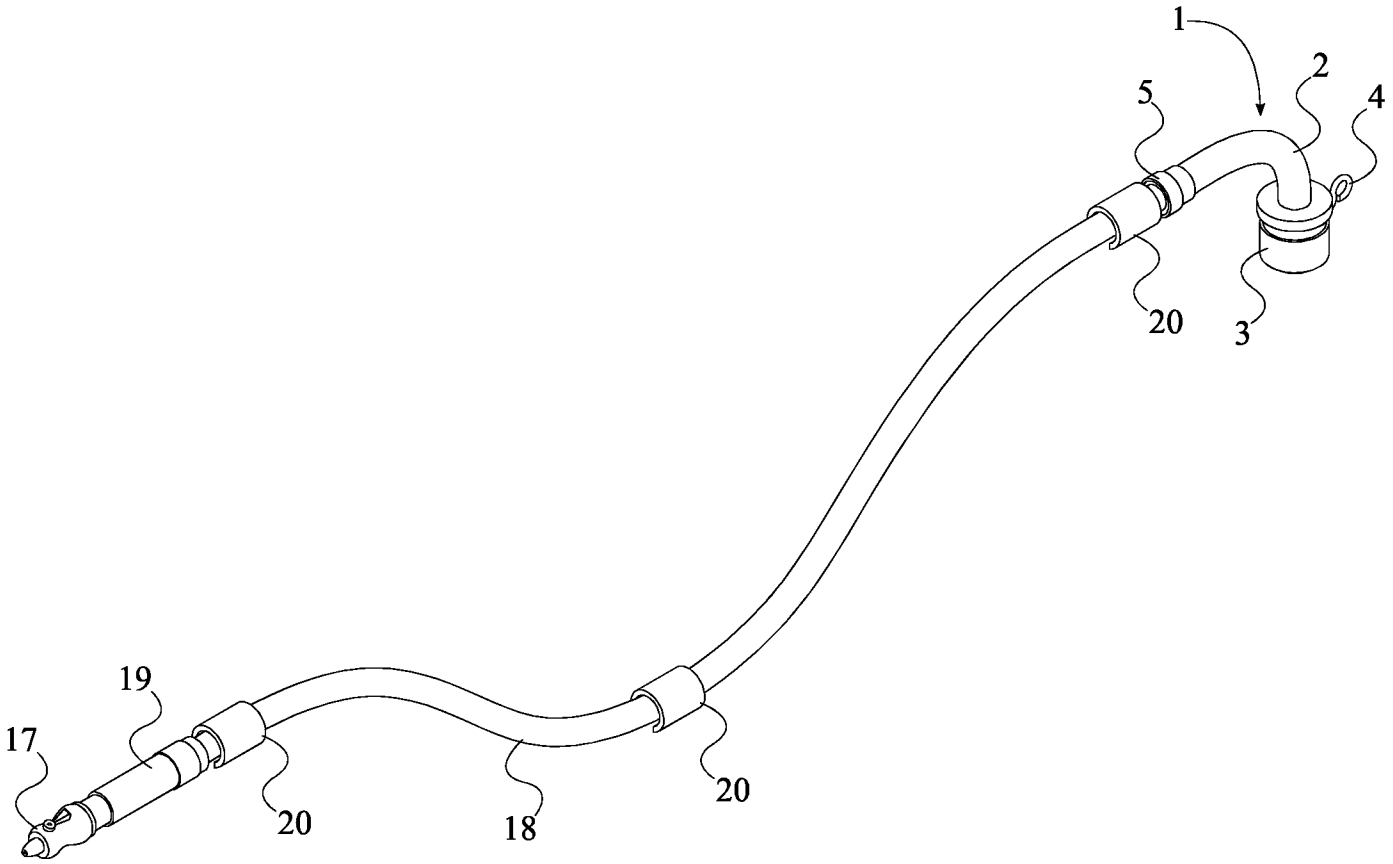
FIG. 7 is a perspective view of a third embodiment of the present invention with the dispensing wand connected to the transformer with the hose.

In a third embodiment of the present invention, the dispensing wand 6 comprises a spout 17, seen in FIG. 7. The spout 17 serves as a handheld massager for the hot tub, utilizing the pressurized water from a corresponding jet. The spout 17 is hermetically connected with the hose coupler 5, preferably through the flexible hose 18 and the adapter 19. Furthermore, the transformer 1 is in fluid communication with the spout 17.

Although the invention has been explained in relation to its preferred embodiment, it is to be understood that many other possible modifications and variations can be made without departing from the spirit and scope of the invention as hereinafter claimed.

What is claimed is:

1. A spa filtration and massage system for a hot tub comprises:

a transformer;

a dispensing wand;

the transformer comprises an elongated tube, an inlet plug, a tightening bolt, and a hose coupler;

the inlet plug being terminally positioned to the elongated tube;

the tightening bolt being externally mounted with the inlet plug;

the hose coupler being terminally positioned to the elongated tube, opposite the inlet plug;

the dispensing wand being hermetically connected with the hose coupler;

the inlet plug being in fluid communication with the elongated tube;

the elongated tube being in fluid communication with the hose coupler;

the hose coupler being in fluid communication with the dispensing wand;

a plurality of floating nodes;

the flexible hose being traversing through each of the plurality of floating nodes; and, the plurality of floating nodes being attached along with the flexible hose.

2. The spa filtration and massage system for a hot tub as claimed in claim 1 comprises:

a flexible hose;

an adapter;

the flexible hose being terminally positioned to the hose coupler;

the adapter and the dispensing wand being terminally positioned to the flexible hose, opposite the hose coupler;

the hose coupler being in fluid communication with the flexible hose; and, the flexible hose being in fluid communication with the dispensing wand through the adapter.

3. The spa filtration and massage system for a hot tub as claimed in claim 1 comprises:

the dispensing wand comprises a spray nozzle, a valve, an actuator;

the spray nozzle being hermetically connected with the hose coupler;

the actuator being mounted onto the spray nozzle;

the valve being integrated into the spray nozzle;

the transformer being in fluid communication with the spray nozzle; and, the actuator being operatively coupled to the valve, wherein the actuator is used to open or close the valve for the spray nozzle.

4. A spa filtration and massage system for a hot tub comprises:

a transformer;

a dispensing wand;

a flexible hose;

an adapter;

the transformer comprises an elongated tube, an inlet plug, a tightening bolt, and a hose coupler;

the inlet plug being terminally positioned to the elongated tube;

the tightening bolt being externally mounted with the inlet plug;

the hose coupler being terminally positioned to the elongated tube, opposite the inlet plug;

the dispensing wand being hermetically connected with the hose coupler;

the inlet plug being in fluid communication with the elongated tube;

the elongated tube being in fluid communication with the hose coupler;

the hose coupler being in fluid communication with the dispensing wand;

the flexible hose being terminally positioned to the hose coupler;

the adapter and the dispensing wand being terminally positioned to the flexible hose, opposite the hose coupler;

the hose coupler being in fluid communication with the flexible hose;

the flexible hose being in fluid communication with the dispensing wand through the adapter;

a plurality of floating nodes;

the flexible hose being traversing through each of the plurality of floating nodes; and, the plurality of floating nodes being attached along with the flexible hose.

5. The spa filtration and massage system for a hot tub as claimed in claim 4 comprises:

the dispensing wand comprises a spray nozzle, a valve, an actuator;

the spray nozzle being hermetically connected with the hose coupler;

the actuator being mounted onto the spray nozzle;

the valve being integrated into the spray nozzle;

the transformer being in fluid communication with the spray nozzle; and, the actuator being operatively coupled to the valve, wherein the actuator is used to open or close the valve for the spray nozzle.

* * * * *